US011733652B2

(12) United States Patent
Zbylut

(10) Patent No.: US 11,733,652 B2
(45) Date of Patent: Aug. 22, 2023

(54) HOROLOGICAL DISPLAY SYSTEM

(71) Applicant: ROLEX SA, Geneva (CH)

(72) Inventor: Ludovic Zbylut, Seynod (FR)

(73) Assignee: ROLEX SA, Geneva (CH)

( * ) Notice: Subject to any disclaimer, the term of this patent is extended or adjusted under 35 U.S.C. 154(b) by 1035 days.

(21) Appl. No.: 16/397,252

(22) Filed: Apr. 29, 2019

(65) Prior Publication Data

US 2019/0332066 A1 Oct. 31, 2019

(30) Foreign Application Priority Data

Apr. 30, 2018 (EP) ..... 18170016

(51) Int. Cl.

| | |
|---|---|
| ***G04B 19/16*** | (2006.01) |
| ***G04F 7/08*** | (2006.01) |
| ***G04F 10/00*** | (2006.01) |
| ***G09G 5/37*** | (2006.01) |

(52) U.S. Cl.

CPC ..... *G04B 19/166* (2013.01); *G04F 7/0804* (2013.01); *G04F 7/089* (2013.01); *G04F 7/0809* (2013.01); *G04F 10/00* (2013.01); *G09G 5/37* (2013.01); *G04F 7/08* (2013.01); *G09G 2354/00* (2013.01)

(58) Field of Classification Search

CPC ..... G04B 19/16–166; G04F 7/089; G04F 7/08084; G04F 7/0809; G04F 10/00; G09G 5/37

See application file for complete search history.

(56) References Cited

U.S. PATENT DOCUMENTS 395,696 A * 1/1889 Ethridge ..... G04B 19/163 368/231
403,338 A * 5/1889 Fischer ..... G04B 19/163 368/231
403,525 A * 5/1889 Ethridge ..... G04B 19/16 368/231

(Continued)

FOREIGN PATENT DOCUMENTS

CH 687 796G A3 2/1997
CH 706 204 A2 9/2013

(Continued)

OTHER PUBLICATIONS

Gruring, Pierre-Yves, English Translation of CH 711228, originally published on Dec. 30, 2016, retrieved from Espaceneton on Mar. 24, 2022, full document (Year: 2016).*

(Continued)

*Primary Examiner* — Daniel P Wicklund
(74) *Attorney, Agent, or Firm* — WHDA, LLP

(57) ABSTRACT

A system (100) for displaying time or time derivative information, in particular a measured time, the system including a limb (10) comprising at least one modifiable graphic element (20*a-f*) forming time or time derivative reference information, a member (1) for indicating the time or time derivative information in cooperation with the limb, a device (2, 8, 22, 71) for modifying the graphic element, and a device (3, 4, 34) for resetting, by action of a user, to a predetermined configuration, in particular for resetting to zero, the time or time derivative information displayed by cooperation of the indication member and of the limb.

19 Claims, 7 Drawing Sheets

(56) References Cited

U.S. PATENT DOCUMENTS

| | | | | | |
|---|---|---|---|---|---|
| 1,999,126 | A * | 4/1935 | Gardner | G04B 19/166 | 368/231 |
| 2,824,181 | A * | 2/1958 | Gallagher | G04C 23/16 | 368/108 |
| 2,853,850 | A * | 9/1958 | McLeod | G04F 3/04 | 368/231 |
| 5,943,299 | A | 8/1999 | Genta | | |
| 10,012,958 | B1 * | 7/2018 | Gallimore | G04B 19/163 | |
| 2007/0230286 | A1 * | 10/2007 | Scheufele | G04B 27/005 | 368/190 |
| 2014/0269229 | A1 * | 9/2014 | Boudreaux | G04B 19/166 | 368/231 |
| 2017/0023913 | A1 * | 1/2017 | Lecher | G04C 17/0091 | |
| 2017/0090425 | A1 * | 3/2017 | Lecher | G04B 19/16 | |
| 2019/0332066 | A1 * | 10/2019 | Zbylut | G04F 7/089 | |

FOREIGN PATENT DOCUMENTS

| | | | | |
|---|---|---|---|---|
| CH | 711228 | A1 * | 12/2016 | G04B 19/16 |
| CH | 712 398 | A2 | 10/2017 | |
| CN | 107222590 | A | 9/2017 | |
| EP | 0 869 410 | A1 | 10/1998 | |
| EP | 2 799 938 | A1 | 11/2014 | |

OTHER PUBLICATIONS

European Search Repod and Written Opinion dated Nov. 7, 2018 issued in counterpart application No. EP18170016; w/ English machine translation (16 pages).

* cited by examiner

HOROLOGICAL DISPLAY SYSTEM

This application claims priority of European patent application No. EP18170016.2 filed Apr. 30, 2018, the content of which is hereby incorporated by reference herein in its entirety.

The invention relates to a horological display system. The invention relates also to an actuation system. It relates also to a movement comprising such a display or actuation system. Also, it relates to a timepiece, in particular a wristwatch, comprising such a display or actuation system or such a movement. It relates finally to a method for operating such a display or actuation system, such a movement or such a timepiece.

Devices for displaying a time indication, in particular a measured time, are known from the state of the art, and can in particular take the form of time counters or totalizers such as those known as chronographs. In these devices, a display member, generally taking the form of a hand, is provided to cooperate with a given graduation so as to count, for example, the number of fractions of a second, of seconds, of minutes or of hours that have elapsed.

In the case of a minutes totalizer, it is common practice to count the time on a graduation of 30 minutes, arranged on a circle, so as to make it possible to distinguish the graduations. In this case, the measured time display capacity is generally 30 minutes, and can prove insufficient. In the case of an hours totalizer, it is common practice to count the time on a graduation of 12 hours, arranged on a circle, so as to make it possible to distinguish the graduations. In this case, the measured time display capacity is generally 12 hours, and can prove insufficient.

A timepiece is known from the patent application EP0869410 that comprises a first display member, in the form of a hand, provided to cooperate with a first graduation so as to indicate the minutes, and a second display member, in the form of a disk, which appears in a window so as to indicate the hours. The time displayed constitutes the current time.

The patent application CH687796 discloses, for its part, a mechanism for displaying the current time over 24-hours. A disk can oscillate according to two positions so that a dial can present two configurations; a first configuration of the dial being a representation of the current time from 13 h to 24 h, and a second configuration of the dial being a representation of the current time from 1 h to 12 h.

The patent application EP2799938 discloses an instantaneous jump mechanism implementing a hairspring whose central end is fixed to an tightening mobile and whose distal end is fixed to a display member.

These different embodiments cannot be used to display a measured time. Indeed, such a measured time display function requires the ability to fix the display and to be able to reset it.

The aim of the invention is to provide a display system that makes it possible to remedy the drawbacks mentioned above and to enhance the display systems known from the prior art. In particular, the invention proposes a display system that is compact, reliable and that improves the legibility of the horological information.

According to a first aspect of the invention, a display system is defined by the following definitions:

1. A system for displaying time or time derivative information, in particular a measured time, the system comprising:

a limb comprising at least one modifiable graphic element forming a time or time derivative reference information, a member for indicating time or time derivative information in cooperation with the limb, a device for modifying the graphic element, and a device for resetting, by action of a user, to a predetermined configuration, in particular for resetting to zero, the time or time derivative information displayed by cooperation of the indication member and of the limb.

2. The display system according to the preceding definition, wherein the device for modifying the graphic element is a device for driving the graphic element and wherein the modifiable graphic element is arranged so as to be displaced under the effect of the device for modifying the graphic element and arranged so as to be reset to a determined position by the resetting device.

3. The display system according to one of the preceding definitions, wherein the device for resetting to a predetermined configuration comprises a first element for resetting the indication member to a first predetermined configuration and/or a second element for resetting the graphic element to a second predetermined configuration and/or wherein the at least one modifiable graphic element is arranged such that, in several configurations of the at least one modifiable graphic element, the at least one modifiable graphic element defines or help to define several complementary ranges of a value scale of time or time derivative information.

4. The display system according to the preceding definition, wherein the device for resetting to a predetermined configuration is arranged so as to position the indication member in the first predetermined configuration and the graphic element in the second predetermined configuration by the action of one and the same control member, in particular via one and the same action on the control member.

5. The display system according to one of the preceding definitions, wherein the device for modifying the graphic element comprises:

a support, in particular a disk, representing at least one graphic element, an energy accumulator, a mechanism for transmitting energy to the accumulator as and when the display of the time or time derivative information is incremented and/or upon the displacement of the indication member, and a mechanism for authorizing the movement of the support under the effect of an energy supplied by the accumulator, when the display of the time or time derivative information reaches a predetermined value and/or when the indication member reaches a predetermined position.

6. The display system according to the preceding definition, wherein the energy accumulator comprises a spring, in particular a hairspring, fixed at one of its ends to a frame and bearing at a second of its ends against a plate that is mobile relative to the frame, in particular mobile in rotation relative to the frame, the plate being secured to the support, in particular secured by friction or by indenting, the plate comprising several notches intended to successively receive the second end of the spring.

7. The display system according to definition 5 or 6, wherein the transmission mechanism comprises a mobile kinematically linked with the indication member, in particular a mobile meshing with a wheel secured to the indication member, the mobile comprising a finger arranged so as to act on the energy accumulator, in particular on the second end of the spring, to displace it from one notch to another.

8. The display system according to one of definitions 5 to 7, wherein the authorization mechanism comprises a locking disk provided with a first cutout, kinematically linked with the indication member and cooperating with a plate provided with several second cutouts and secured to the support, in particular secured by friction or indenting, to lock or authorize the rotation of the plate, the locking disk having a first configuration in which the rotation of the plate is authorized and a second configuration in which the rotation of the plate is prohibited by obstruction with the disk.

9. The display system according to one of the preceding definitions, wherein the device for resetting to a predetermined configuration comprises a hammer and a first cam, in particular a heart cam, secured to the indication member and intended to receive an action of a first peen of the hammer and/or wherein the device for resetting to a predetermined configuration comprises a hammer and a second cam secured to the support and intended to receive an action of a second peen of the hammer.

10. The display system according to definition 9, wherein the first peen is mounted to be mobile, in particular mobile in translation, in particular mobile in translation along a first axis, relative to a body of the hammer, and wherein the hammer comprises an element for returning the first peen to a position of rest relative to the body of the hammer, in particular relative to the second peen.

According to the first aspect of the invention, a movement is defined by the following definition:

11. A horological movement comprising a system according to one of the preceding definitions.

According to the first aspect of the invention, a timepiece is defined by the following definition:

12. A timepiece, in particular a wristwatch, comprising a system according to one of the definitions 1 to 10 and/or a horological movement according to definition 11.

According to the first aspect of the invention, an operating method is defined by the following definitions:

13. A method for operating a display system according to one of definitions 1 to 10 or a horological movement according to the definition 11 or a timepiece according to definition 12, the method comprising the following steps:
   - display of time or time derivative information by cooperation of the indication member and of the limb, then
   - action of a user on the display system, in particular elemental action of the user on the display system, for example a press by the user on a push-piece of the display system, then
   - as a consequence of the action step, resetting to a predetermined configuration, in particular resetting to zero, of the time or time derivative information displayed by cooperation of the indication member and of the limb, in particular resetting of the indication member to the first predetermined configuration and/or resetting of the graphic element to a second predetermined configuration.

14. The operating method according to the preceding definition, wherein the display step comprises the following steps:
   - tightening of an energy accumulator by action of a finger, in particular tightening of a spring by action of a finger displacing an end of the spring, then
   - unlocking of the position of a support, then
   - displacement of the support thanks to a mechanical energy released by the energy accumulator.

15. The method for operating a display system according to one of definitions 1 to 10 or a horological movement according to definition 11 or a timepiece according to definition 12, the method comprising the following steps:
   - tightening of an energy accumulator by action of a finger, in particular tightening of a spring by action of a finger displacing an end of the spring, then
   - unlocking of the position of a support, then
   - displacement of the support thanks to a mechanical energy released by the energy accumulator.

According to a second aspect of the invention, an actuation system is defined by the following definitions:

16. A system 150 for actuating a first mobile 21, in particular a disk for displaying time or time derivative information, the system comprising:
   - a frame 9 on which the first mobile 21 is pivoted about a first axis A1,
   - an energy accumulator 8,
   - a mechanism 71 for transmitting energy to the accumulator, and
   - a mechanism for authorizing the movement of the first mobile 21 under the effect of an energy supplied by the accumulator.

17. The actuation system according to the preceding definition, wherein the energy accumulator comprises a spring, in particular a hairspring, fixed at a first of its ends to the frame 9 and bearing at a second of its ends against the first mobile, the first mobile comprising several notches 221*a-d* intended to successively receive the second end of the spring.

18. The actuation system according to one of definitions 16 and 17, wherein the transmission mechanism comprises a second mobile 71 driven in movement, in particular driven in rotational movement about a second axis A2 parallel or substantially parallel to the first axis A1, the second mobile comprising a finger 72 arranged so as to act on the energy accumulator to tighten it, in particular to act on the second end of the spring to displace it from one notch to another.

19. The actuation system according to one of definitions 16 to 18, wherein the authorization mechanism comprises a third mobile provided with a locking disk 720 provided with a first cutout 721, driven in movement, in particular driven in rotational movement about a third axis parallel or substantially parallel to the first axis A1 and cooperating with several second cutouts 223*a-d* produced on the first mobile to lock or authorize the rotation of the first mobile, the locking disk having a first configuration in which the rotation of the first mobile is authorized and a second configuration in which the rotation of the first mobile is prohibited by obstruction with the locking disk.

20. The actuation system according to the preceding definition, wherein the second and third mobiles are one and the same mobile.

21. The actuation system according to one of definitions 16 to 20 and definition 17, wherein the notches are formed at the vertices of a regular polygon and centered on the first axis A1.

22. The actuation system according to one of definitions 16 to 21 and definition 17, wherein each notch is linked by guiding surfaces 222*a-d* to the adjacent notches.

23. The actuation system according to one of definitions 16 to 22 and definition 17, wherein each notch is arranged so as to cooperate with the energy accumulator to define a stable position of the first mobile, the energy accumulator producing an effort causing to return the first mobile to the stable position defined by the cooperation of the accumulator, of the notch and of an abutment 83*a*.

24. The actuation system according to one of definitions 16 to 23 and according to definition 17, wherein the first mobile comprises a body 22 provided with notches and a member 2 of the first mobile 21, in particular a disk mounted to be mobile with friction, in particular mobile by indenting, on the body about the first axis A1.
25. The actuation system according to the preceding definition, wherein it comprises a device 4, 34 for resetting the first mobile to a predetermined configuration comprising an element 4 for resetting member 2 of the first mobile 21 to a predetermined configuration, in particular a cam 4.

According to the second aspect of the invention, a movement is defined by the following definition:

26. A horological movement 200 comprising a system 150 according to one of definitions 16 to 25.

According to the second aspect of the invention, a timepiece is defined by the following definition:

27. A timepiece 300, in particular a wristwatch, comprising a system 150 according to one of definitions 16 to 25 and/or a horological movement according to definition 26.

According to the second aspect of the invention, an operating method is defined by the following definitions:

28. A method for operating an actuation system according to one of definitions 16 to 25 or a horological movement according to definition 26 or a timepiece according to definition 27, the method comprising the following steps:
    setting of the first mobile to a first configuration, then
    action of a user on the actuation system, in particular elementary action of the user on the actuation system, for example a press by the user on a push-piece OC of the actuation system, then
    as a consequence of the action step, resetting of the first mobile to a predetermined configuration.
29. The operating method according to the preceding definition, wherein the setting to a first configuration comprises the following steps:
    tightening of an energy accumulator by action of a finger 72, in particular tightening of a spring by action of a finger 72 displacing an end of the spring, then
    unlocking of the position of the first mobile 21, then
    displacement of the first mobile 21 thanks to a mechanical energy released by the energy accumulator.
30. A method for operating an actuation system according to one of definitions 16 to 25 or a horological movement according to definition 26 or a timepiece according to definition 27, the method comprising the following steps:
    tightening of an energy accumulator by action of a finger 72, in particular tightening of a spring by action of a finger 72 displacing an end of the spring, then
    unlocking of the position of the first mobile 21, then
    displacement of the first mobile 21 thanks to a mechanical energy released by the energy accumulator.

Saving any logical or technical incompatibility, any combination of the features of the first and second aspects can be produced.

The attached figures represent, by way of example, an embodiment of a timepiece incorporating an embodiment of a display system or an embodiment of an actuation system.

Figure 1:
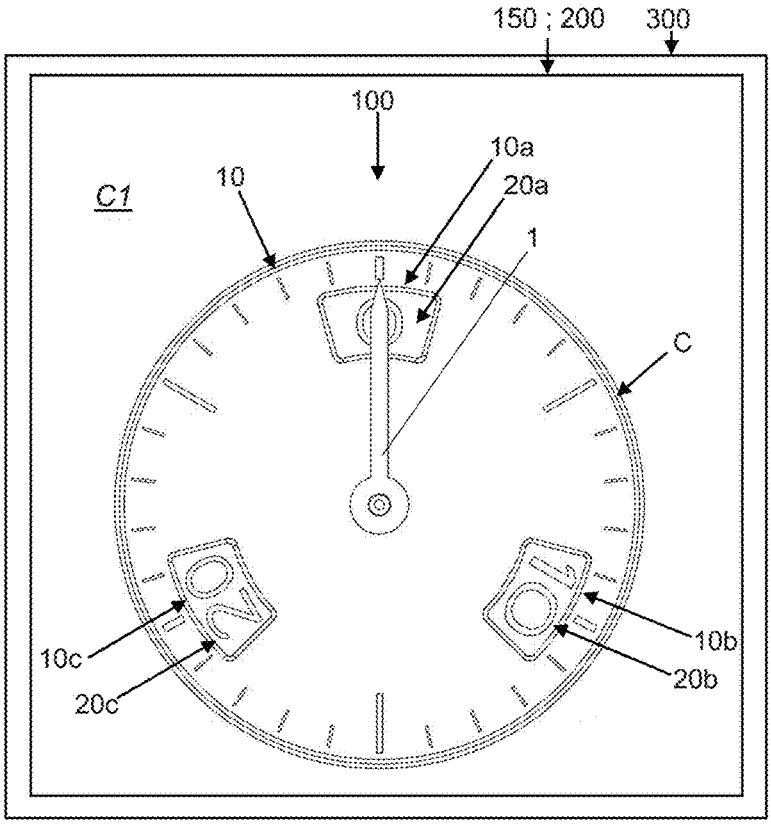
FIG. 1 is a representation of an embodiment of a timepiece comprising an embodiment of a display system in a first configuration.

According to a first aspect, an embodiment of a timepiece 300 is described hereinbelow with reference to FIGS. 1 to 14. The timepiece is preferably a watch, in particular a wristwatch.

The timepiece comprises a horological movement. The horological movement can be of electronic or mechanical type, in particular automatic.

The horological movement advantageously comprises a chronograph system, for example a chronograph module.

The horological movement, in particular the chronograph system, comprises an embodiment of a system 100 for displaying time or time derivative information, in particular a system 100 for displaying a measured time.

The system 100 for displaying time or time derivative information comprises:

- a limb 10 comprising at least one modifiable graphic element 20*a-f* forming time or time derivative reference information,
- a member 1 for indicating time or time derivative information in cooperation with the limb,
- a device 2, 8, 22, 71 for modifying the graphic element, and
- a device 3, 4, 34 for resetting, by action of a user, to a predetermined configuration, in particular for resetting to zero, the time or time derivative information displayed by cooperation of the indication member and of the limb.

The time or time derivative information can in particular be hour information and/or minute information and/or second information and/or fraction-of-a-second information. This information can be current timing information or recorded timing information.

The display system can also comprise a frame 9, in particular an movement-blank 9.

The limb can be formed over a complete circle or be formed over only a circular arc. By extension, the limb can be realized as a straight-line segment. More generally, the limb can have any straight or curved form. The display system can comprise a dial and the limb can be realized on the dial. The display system can comprise a counter and the limb can be realized on the counter. The limb can comprise or be associated with a graduation. Such a graduation can be realized on the dial or on the counter.

The graphic element can be any form or any mark 20*a*, 20*b*, 20*c*, 20*d*, 20*e*, 20*f*. The graphic element can comprise an alphabetical character or an alphanumeric character string. Preferably, the graphic element is one or more numeric characters. Preferably, the dial comprises one or more windows or apertures 10*a*, 10*b*, 10*c* and the graphic element cooperates with the windows or the apertures, that is to say that the graphic element is visible in a window or an aperture.

Preferably, the display system comprises a support 2, in particular a disk 2, having at least one graphic element.

The graphic element is a reference or defines a reference for the limb with which it is associated. Advantageously, the graphic element is a reference or defines a reference for the graduation with which it is associated. For example, the graphic element defines a limb origin or a graduation origin. In particular, the graphic element gives a meaning to the limb or to the graduation or to the graduation associated with the limb.

For example, FIG. 1 represents the display system 100 in a first display configuration C1. The system comprises a dial with a limb on which three apertures are arranged. In this configuration, the support 2 is arranged so that the graphic elements "0", "10" and "20" appear in the apertures. Thus, it is understood that the origin of the limb is "0" and that it makes it possible to read an integer value of between 0 and 29.

Figure 2:
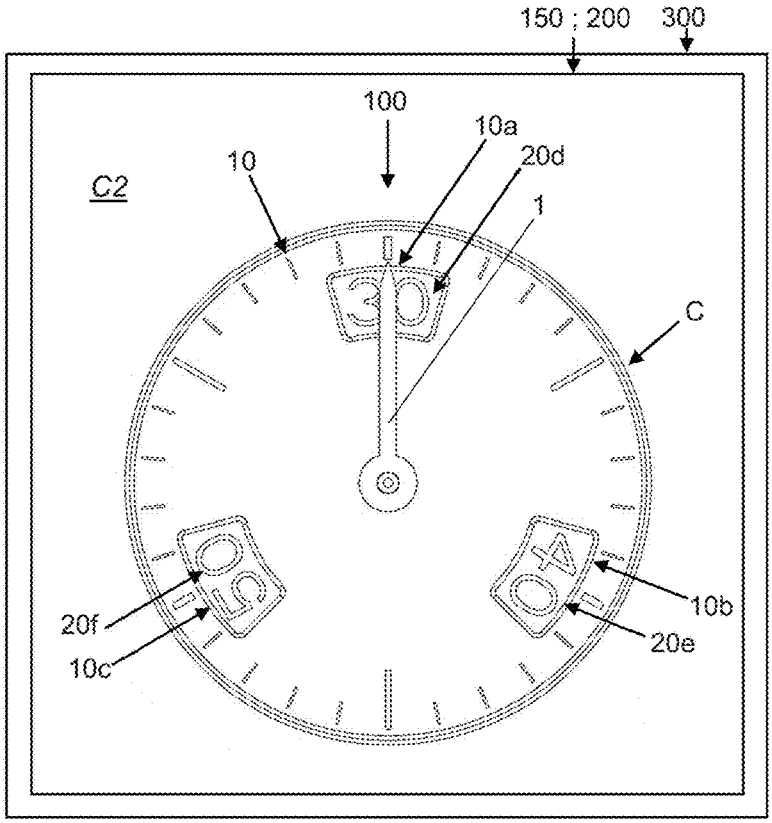
FIG. 2 is a representation of the embodiment of the timepiece with the embodiment of the display system in a second configuration.

For example, FIG. 2 represents the display system 100 in a second display configuration C2. In this configuration, the support 2 is arranged so that the graphic elements "30", "40" and "50" appear in the apertures. Thus, it is understood that the origin of the limb is "30" and that it makes it possible to read an integer value of between 30 and 59.

Thus, the limb 10 can be modulated as a function of the graphic elements visible to the wearer of the timepiece, in particular as a function of the graphic elements likely to appear in the apertures 10*a*, 10*b*, 10*c*.

The indicator member 1 is, for example, a hand. More generally, the indicator member can be any cursor or any member making it possible to point to or indicate a point of the limb and consequently indicate a value, even approximately, by cooperation with the limb.

For example, the indicator member 1 is mounted to be mobile relative to the frame, in particular mobile relative to the frame in rotation about the axis A1.

In the embodiment represented, the indicator member is a hand cooperating with a first graduation 10 extending over a circle C.

Figure 3:
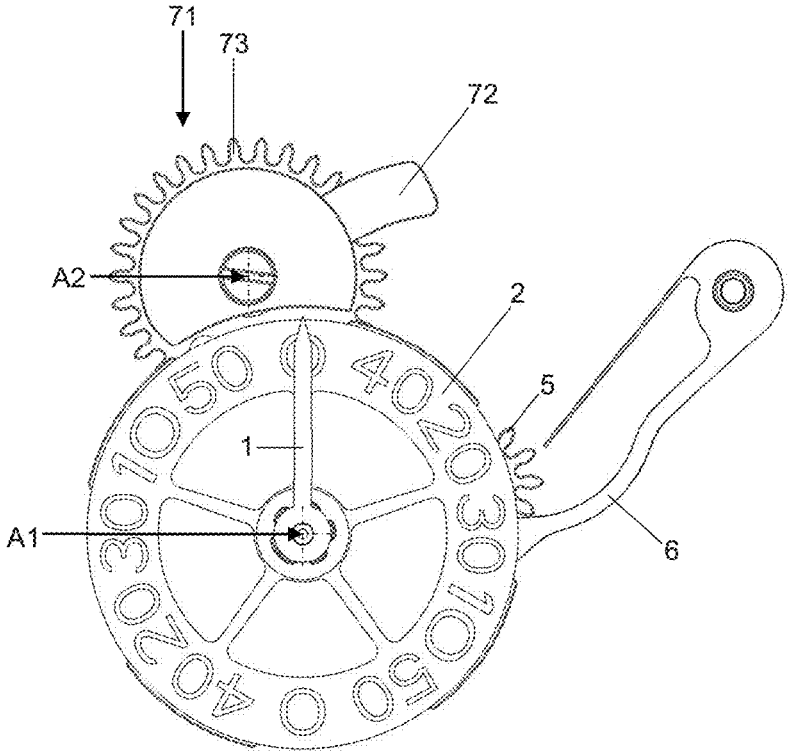
FIG. 3 is a partial front view of the embodiment of the display system.
Figure 4:
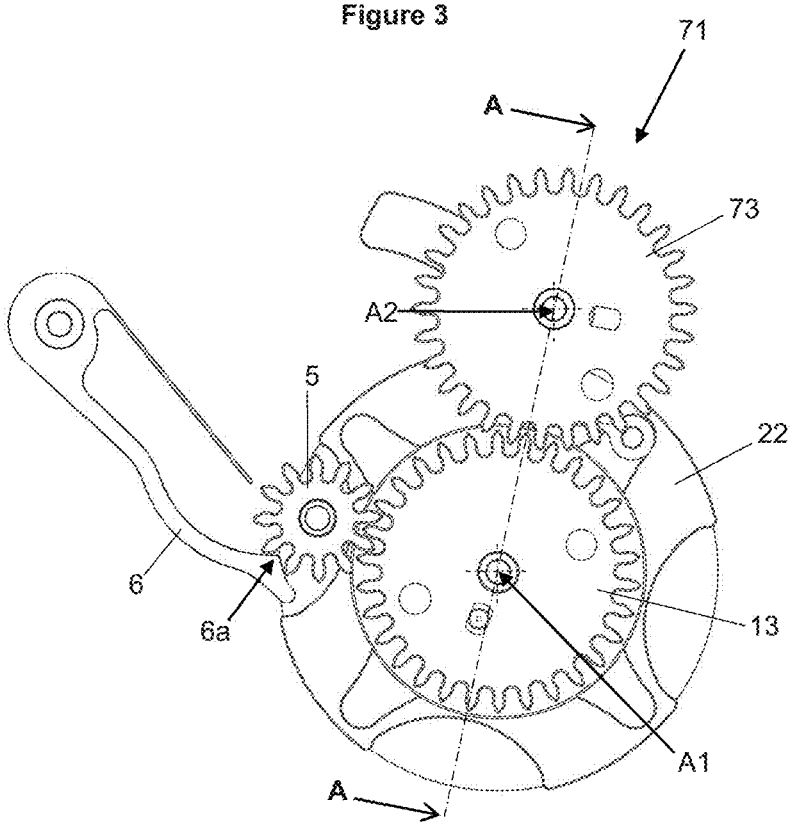
FIG. 4 is a partial rear view of the embodiment of the display system.

The display system also comprises a mechanism for driving the indicator member 1 which is described hereinbelow with reference to FIGS. 3 to 5. The indicator member is fixed to a pivot-shank 12 of a first mobile 11 onto which is also driven a wheel 13. This wheel 13 can be actuated periodically through a pinion 5 which can itself be actuated periodically through a driving system that is not represented. The angular indexing of the indicator member 1 is, for its part, for example implemented through a jumper 6 whose nose 6*a* acts directly against the teeth of the pinion 5. Thus, the indicator member 1 is, for example, capable of performing an angular step every fraction of a second or every second or every minute or every hour through the driving mechanism and can be held in position between two jumps through an indexing jumper 6, 6*a*.

Advantageously, the switching of the display system 100 from the first configuration C1 to the second configuration C2 is performed at the moment when the indicator member 1 is situated facing the origin of the limb or the aperture 10*a*, after having traveled a first time over the entire length of the limb, in particular after having covered a first rotation corresponding to the extent of the circle C. Advantageously, this switching is performed perfectly instantaneously.

The switching of the display system 100 from the second configuration C2 to the first configuration C1 is performed at the moment when the indicator member 1 is situated once again facing the origin of the limb or the aperture 10*a*, after having covered the entire length of the limb for a second time, in particular after having covered a second rotation corresponding to the extent of the circle C. Advantageously, this switching is performed instantaneously.

Preferably, the device 2, 8, 22, 71 for modifying the graphic element is a device for driving the graphic element, in particular a device for driving the support 2 bearing the modifiable graphic elements 20*a-f*. The support and/or the graphic elements are arranged so as to be displaced under the effect of the device 2, 8, 22, 71 for modifying the graphic element. Moreover, the support and/or the graphic elements are advantageously also arranged so as to be reset to a determined position by the position resetting device 3, 4, 34. Thus, the modifiable graphic element is for example modifiable by displacement, in particular the modifiable graphic element can be modified by:

- displacement of a first graphic element 20*a* visible in a first location, in particular in the aperture 10*a*, from this first location to a second location, in particular a second location where it is no longer visible;

and, simultaneously, or in succession

- displacement of a second graphic element 20*d*, in particular a second graphic element 20*d* not visible in a third location, from this third location to the first location, in particular the first location where it is visible.

The device for modifying the graphic element comprises:

- the support 2, in particular the disk, having at least one graphic element,
- an energy accumulator 8,
- a mechanism 71 for transmitting energy to the accumulator as and when the display of the time or time derivative information is incremented and/or upon the displacement of the indication member 1, and
- a mechanism for authorizing the movement of the support 2 under the effect of an energy supplied by the accumulator, when the display of the time or time derivative information reaches a predetermined value and/or when the indication member 1 reaches a predetermined position.

The energy accumulator 8 can comprise a spring, in particular a hairspring 81, fixed at a first of its ends 81*b* to the frame 9 and bearing at a second of its ends against a plate 22 that is mobile relative to the frame, in particular mobile relative to the frame in rotation about the axis A1.

The plate is, for example, secured to the support. In particular, the plate is advantageously secured to the support by friction or by indenting so as to be able to be disengaged from the support. The plate comprises several notches 221*a-d* intended to successively receive the second end 81*a* of the spring. In the embodiment represented, the plate comprises four notches regularly distributed angularly about the axis A1. Thus, the plate 22 comprises a hollowed-out cutout 221 in the form of a star, whose branches form the notches 221*a*, 221*b*, 221*c*, 221*d* which are provided to receive the second end of the spring.

The first of its ends (the central end 81*b*) is immobilized in rotation through an abutment 82 which takes, for example, the form of a tenon 82 added to the frame 9. The second of its ends (the distal end 81*a*) is formed by or comprising a pin 84. This pin 84 is intended to cooperate with the notches 221*a-d* mentioned previously.

Moreover, the pin 84 is arranged so as to be held in abutment against an end 83*a* of a cam path 83 formed or hollowed out, for example, on the frame 9. In this way, the spring 81 can be arranged unequivocally and held prestressed facing the frame 9.

Thus, the accumulator is arranged so as to act on the support 2 through an intermediate element 22 which takes the form of the plate.

The support-plate assembly is mounted on a tubular element 23, pivoted on the frame 9, so as to form a second mobile 21 which is guided in rotation about the pivot-shank 12 on which the indicator member 1 is mounted.

The transmission mechanism advantageously comprises a third mobile 71 kinematically linked with the indication member 1, in particular a third mobile meshing with a wheel 13 of the first mobile and therefore secured to the indication member 1. The third mobile 71 is mobile relative to the frame 9, in particular mobile in rotation relative to the frame 9 about an axis A2 parallel to the axis A1. The third mobile 71 comprises a finger 72 arranged so as to act on the energy accumulator, in particular on the second end 81*a* of the spring, in particular on the pin 84, to displace it from a first notch 221*a* to an adjacent second notch 221*b* of the plate 22. This displacement is done against the action of the accumulator. In this displacement, the second end of the accumulator is guided by a flank 222*a* of the cutout 221, this flank linking the first notch 221*a* to the adjacent second notch 221*b* of the plate 22.

The driving of the support 2 is produced through the driving finger 72. The finger is for example kinematically linked to the wheel 13 through a wheel 73 which is secured to it. Thus, the periodic driving of the indication member 1 also drives the periodic rotation of the third mobile 71 comprising the driving finger 72 and the wheel 73.

The finger 72 is consequently arranged so as to act on the support 2 via the energy accumulator 8.

The authorization mechanism comprises a locking disk 720 provided with a first cutout 721, kinematically linked with the indication member 1 and cooperating with the plate 22 provided with several second cutouts 223*a-d* for locking or authorizing the rotation of the plate. The locking disk 720 advantageously forms part of the third mobile 71. Preferably, the locking disk 720 and the finger 72 are aligned or positioned angularly about the axis A2 in order to act in a synchronized manner on the first mobile. The locking disk cooperates by obstruction with the first mobile, in particular with a conformation of the first mobile, in particular with a periphery 220 of the plate 22 of the first mobile to authorize or prohibit the rotation of the first mobile relative to the frame 9 about the axis A1.

The periphery 220 of the plate 22 advantageously has a Maltese cross geometry. The second cutouts 223*a-d* advantageously have forms complementing or substantially complementing the form of the locking disk (other than at the first cutout 721).

Thus, the locking disk has a first configuration (comprising several positions including those represented in FIGS. 7 and 11) in which the rotation of the plate is authorized or partially authorized.

Moreover, the locking disk has a second configuration (comprising several positions including those represented in FIGS. 8, 9 and 10) in which the rotation of the plate is prohibited by obstruction with the locking disk.

The device 3, 4, 34 for resetting to a predetermined configuration advantageously comprises:

- a first element 3 for resetting the indication member to a first predetermined configuration; and/or
- a second element 4 for resetting the graphic element 20*a-f* to a second predetermined configuration.

Figure 12:
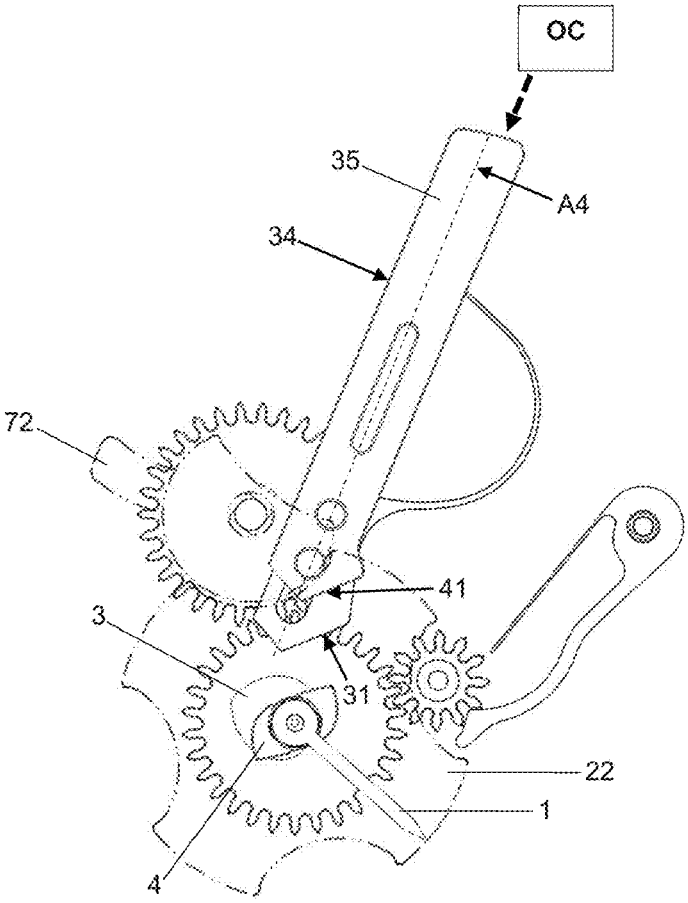
FIG. 12 is a partial rear view of the embodiment of the display system with elements for initializing the display represented in a first position.
Figure 13:
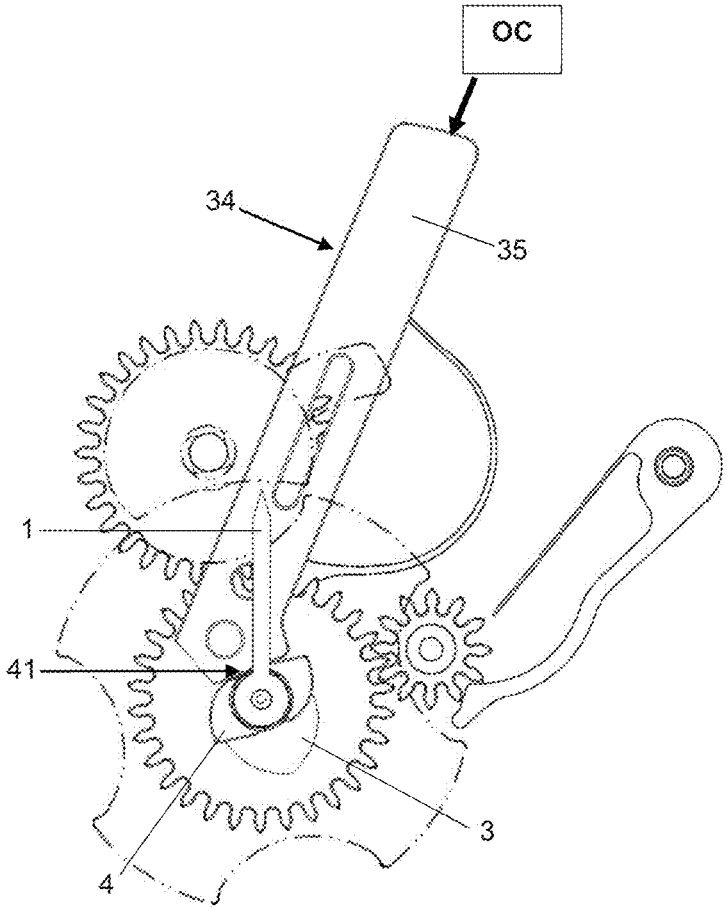
FIG. 13 is a partial rear view of the embodiment of the display system with the elements for initializing the display represented in a second position.

Preferably, the device for resetting to a predetermined configuration is arranged so as to position the indication member in the first predetermined configuration and the graphic element 20*a-f* in the second predetermined configuration by the action of one and the same control member, in particular via one and the same action on the control member OC represented schematically in FIGS. 12 and 13. Advantageously, this control member can be actuated by the wearer of the timepiece. For example, the action of the wearer of the timepiece can be a press on a push-piece. In the example described, the consequences of such an action are to:

- reset the graphic element 20*a* indicating "0" in the aperture 10*a* (and reset the graphic elements 20*b* and 20*c* respectively indicating "10" and "20" in the apertures 10*b* and 10*c*; and
- reset the indicator member to a configuration pointing to the aperture 10*a*.

These position resets are done sequentially or quasi-sequentially with, first of all, the resetting of the indication member to the first predetermined configuration, then the resetting of the graphic element 20*a-f* to the second predetermined configuration. These steps are nevertheless rapid or instantaneous and are therefore perceived as being simultaneous or substantially simultaneous.

The device 3, 4, 34 for resetting to a predetermined configuration comprises in particular:

- a hammer 34 and a first cam 3, in particular a heart cam, secured to the first mobile 11 and intended to receive an action of a first peen 31 of the hammer 34; and/or
- a hammer 34 and a second cam 4 secured to the support and intended to receive an action of a second peen 41 of the hammer 34.

As represented in FIGS. 12 and 13, one and the same hammer 34 can be arranged so as to act on the first element 3 for resetting the indication member to a first predetermined configuration and on the second element 4 for resetting the graphic element 20*a-f* to a second predetermined configuration. This hammer can advantageously be kinematically linked to the control member OC that can be manipulated by the wearer of the timepiece.

Advantageously, the hammer is mounted to be mobile in translation relative to the frame 9 along an axis A4.

Figure 14:
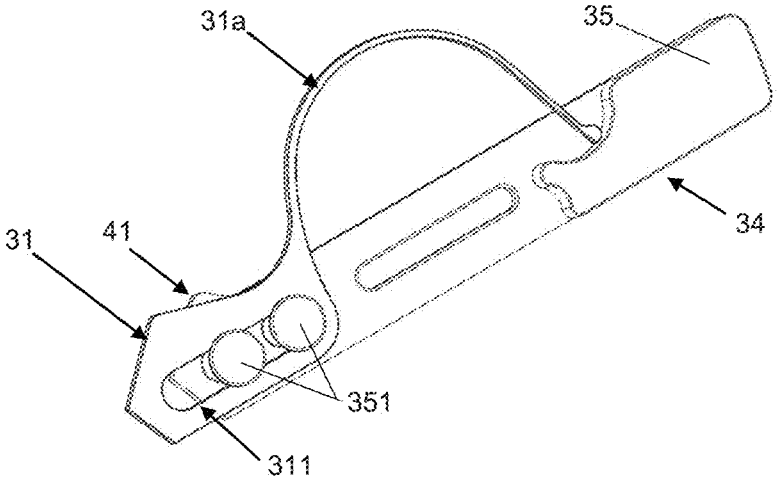
FIG. 14 is a perspective view of an example of elements for initializing the display.

The first peen 31 can have a degree of freedom relative to the second peen 41 so as to allow a predefined sequencing of resetting to predetermined positions. Also preferably, the first peen 31 is mounted to be mobile, in particular mobile in translation, in particular mobile in translation along the axis A4, relative to a body 35 of the hammer. The hammer comprises an element 31*a* for returning the first peen 31 to a position of rest relative to the body of the hammer, in particular relative to the second peen 41. This position of rest of the first peen 31 is represented in FIGS. 12 and 14. The prismatic joint between the first peen 31 and the body of the hammer can be produced by pins 351 provided on the body 35 and cooperating with a groove 311 produced on the first peen 31.

For example, the element 31*a* for returning the first peen 31 to the position of rest comprises an elastic arm 31*a* which is made of the same material as the first peen 31 or in one piece with the first peen 31.

Figure 5:
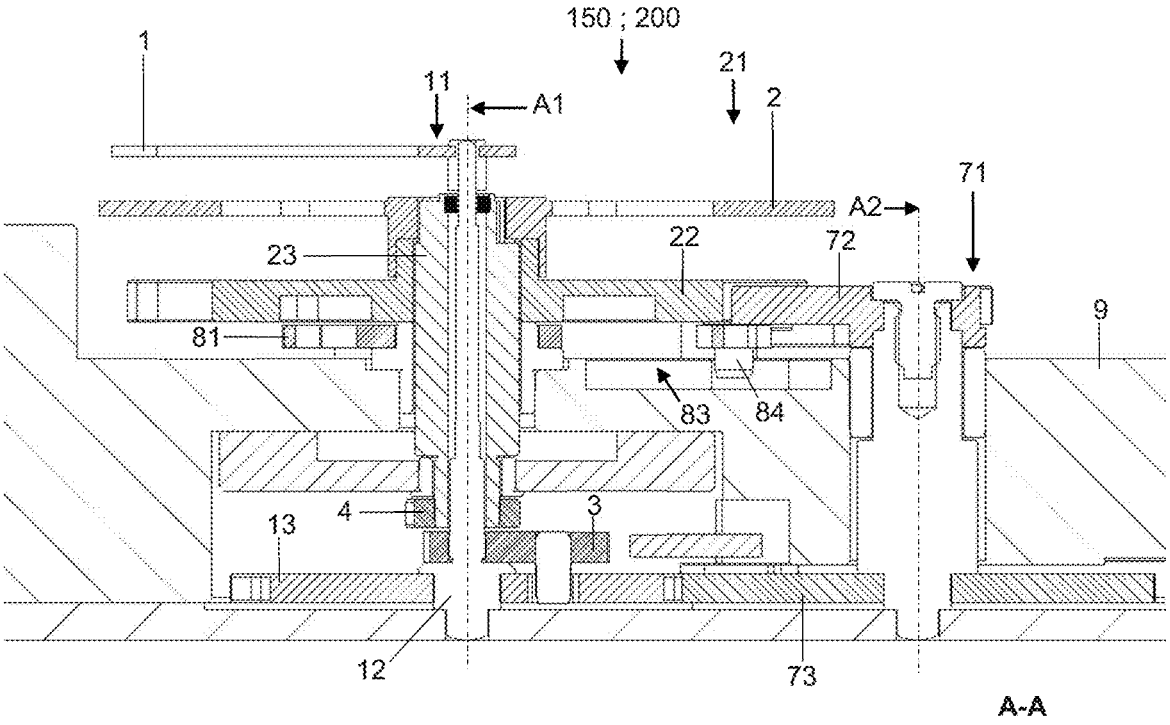
FIG. 5 is a sectional view along the plane A-A as represented in FIG. 4 of the embodiment of the display system.
Figure 6:
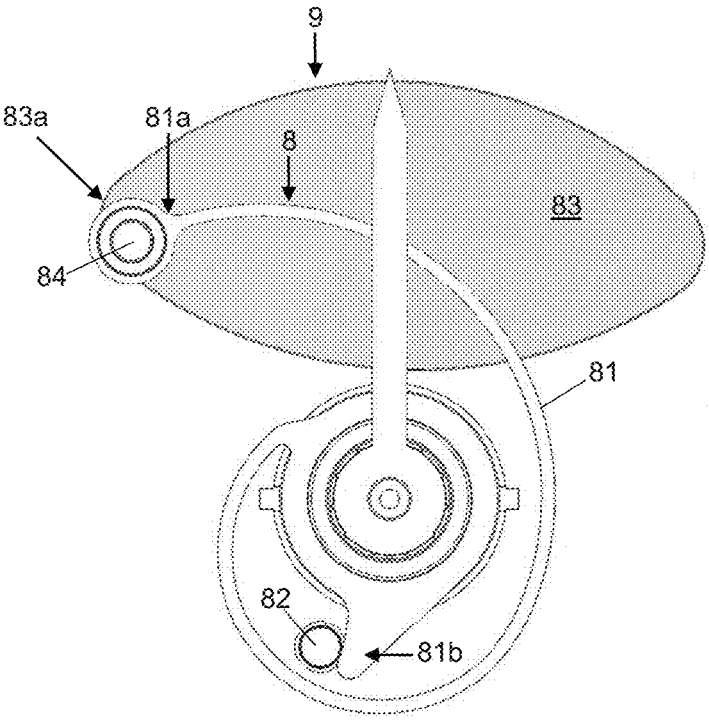
FIG. 6 is a partial front view of the embodiment of the display system, a hand and a return spring for this hand being visible.

As represented in FIG. 5, the cam 3 can be driven onto the pivot-shank 12 and indexed angularly relative to the wheel 13. This cam 3 has, for example, the form of a heart as can be seen in FIGS. 12 and 13 such that the first peen 31 can reset the first mobile and therefore the indication member to the first predetermined configuration P1, which can for example be the position that the hand 1 occupies in FIGS. 1 and 2.

Figure 7:
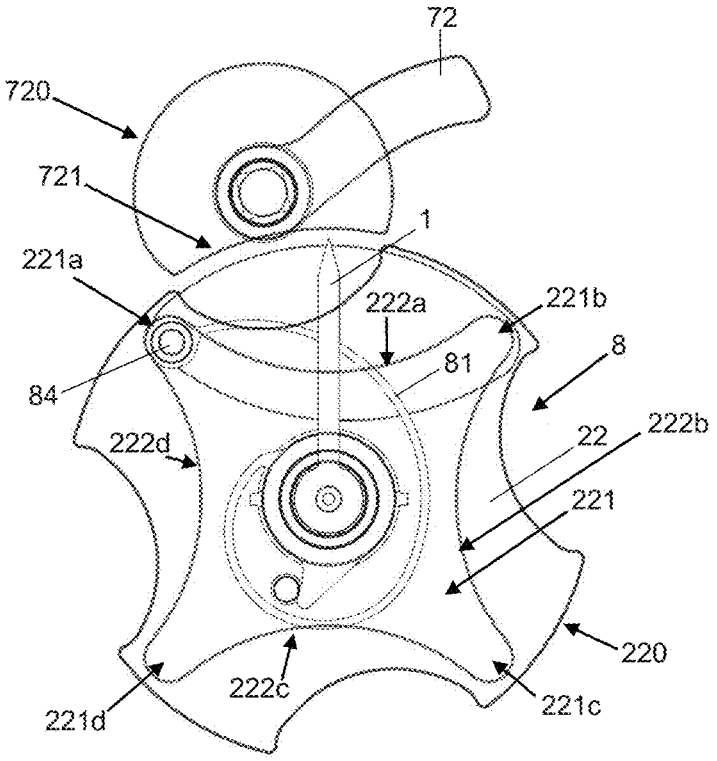
FIGS. 7 to 11 are partial front views of the embodiment of the display system in different positions or configurations illustrating the operation of the display system.
Figure 11:
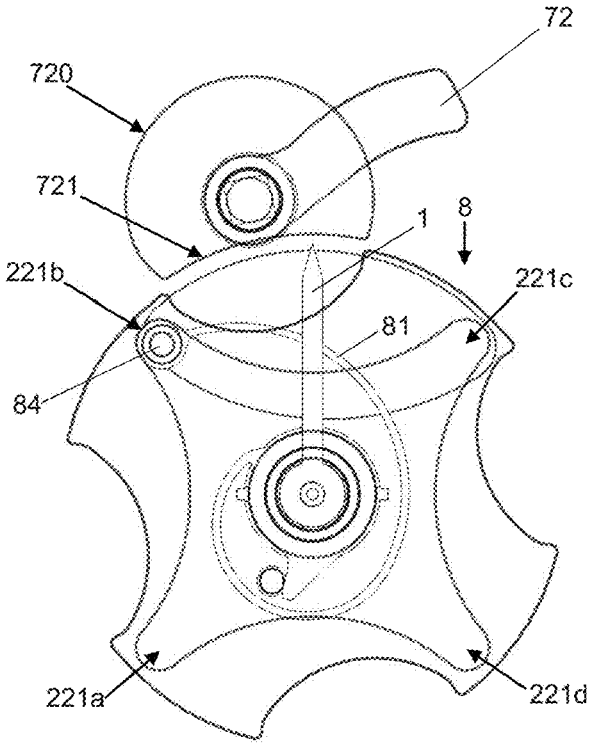

The resetting of the first mobile to the first predetermined configuration P1 also induces a position resetting of the plate 22 to a stable position such as that represented in FIGS. 7 and 11. In effect, the resetting of the first mobile to the first predetermined configuration induces a resetting of the third mobile 71 to a predetermined position and therefore a resetting of the locking disk 720 to a predetermined position as represented in FIGS. 7 and 11. In this configuration of the third mobile 71, the locking disk authorizes the rotation of the plate 22 and therefore the rotation of the second mobile.

Moreover, as represented in FIG. 5, the cam 4 is fixed onto the tubular element 23 on which the support 2 is mounted. This cam 4 represented in FIGS. 12 and 13 can be conformed so that the second peen 41 can reset the support 2 to a predetermined position P2, which can, for example, be the position that the support 2 occupies in FIGS. 1 and 3. Given that the support 2 is mounted with friction on the plate 22, the support 2 and the cam 4 can be disengaged from the plate 22 for the time it takes for the resetting to the predetermined position. This allows for independent resettings of the support and of the plate 22 to predetermined configurations.

An embodiment of a method for operating a display system described previously or a horological movement described previously or a timepiece described previously is described hereinbelow with reference to FIGS. 7 to 11 in which, in the interests of clarity, the support 2, and also the wheels 13 and 73 are not represented.

The operating method comprises the following steps.

It is assumed that, in a first step, the display system is in its initialized configuration or has been reset to initial configuration or has been reset to zero. This configuration is represented in FIG. 7. In this figure, the indication member is arranged in position facing the aperture 10*a*, as represented in FIGS. 1 and 2. The indication member can be held in this position through the jumper 6. The plate 22 is, for its part, held in position through the spring 81 and the pin 84 which is housed in a first notch 221*a* of the plate 22 and which is pressed against the abutment 83*a* formed on the frame 9. FIG. 7 can, for example, represent the state of the display system 100 before the triggering of the chronograph system, and in particular before the triggering of the mechanism driving the first mobile. In this configuration, the support 2 is advantageously arranged so that the graphic element "0" appears in the aperture 10*a*.

Figure 8:
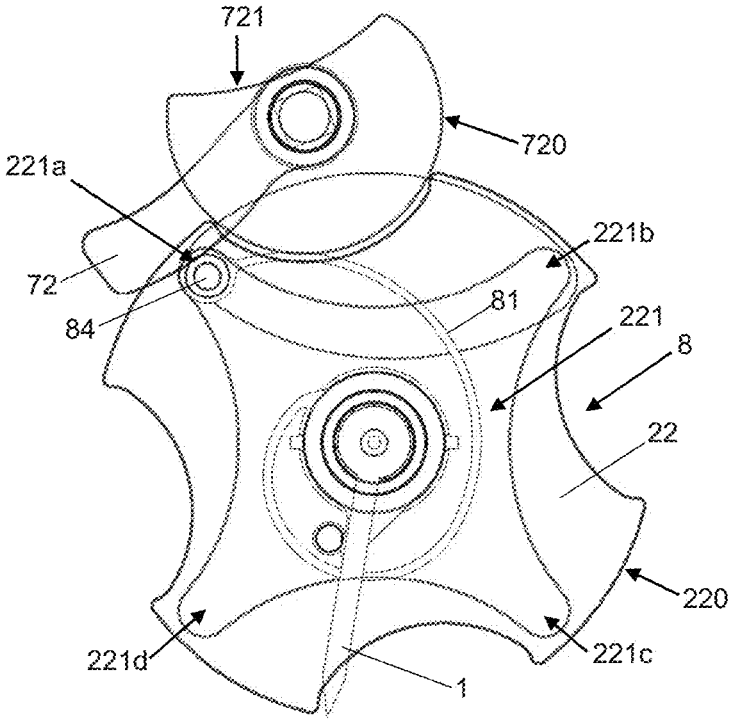

Then, in a second step represented in FIG. 8, the display system displays time or time derivative information by cooperation of the indication member and of the limb. This step is for example obtained after the triggering of the chronograph system. FIG. 8 represents the display system 100 once the mechanism driving the first mobile has been triggered. The rotation of the wheel 13 and therefore of the first mobile 11 induces the movement of the indication member 1, and consequently of the wheel 73 and of the finger 72. In this FIG. 8, the indication member 1 has traveled a little more than half the extent of the limb, and the driving finger 72 has just come into contact with the pin 84 of the spring 81.

Figure 9:
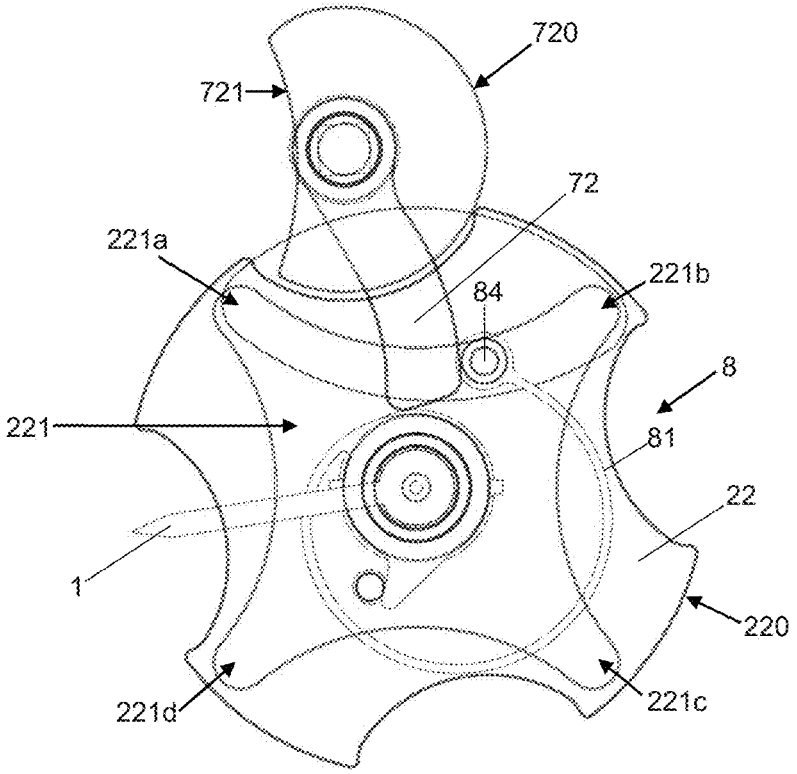
Figure 10:
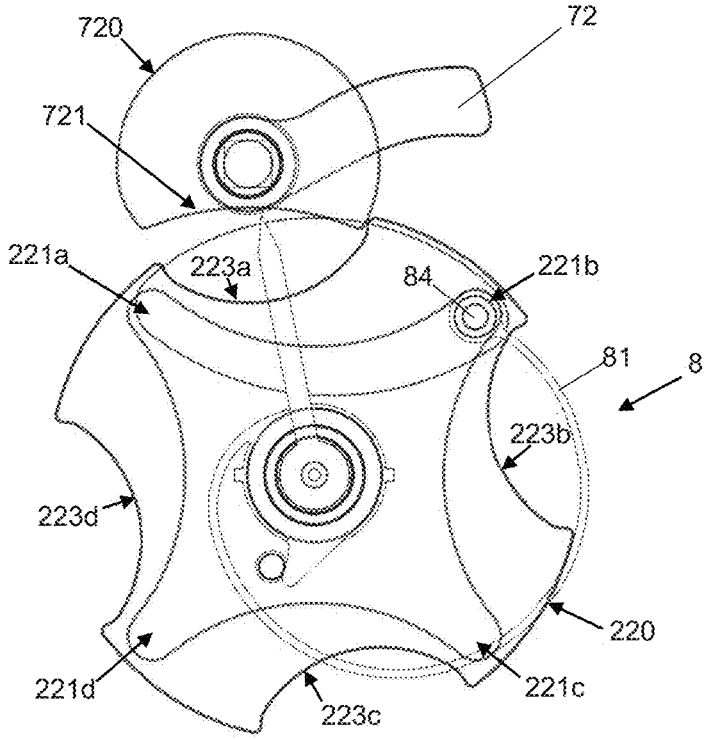

Then, in a third step represented in FIG. 9, the display system tightens the energy accumulator 8 or stores energy in the energy accumulator 8. This action is for example performed by an action of the finger 72 displacing the second end 81*a* of the spring. In this third step, the pin 84 is, for example, guided by the flank linking the first notch 221*a* to the adjacent second notch 221*b* of the plate 22 and by the cam path 83 formed on the frame 9. In this configuration, the second end 81*a* of the spring is no longer in contact with the abutment 83*a* and the spring causes to rotate the second mobile 21, in particular the plate 22, in the anticlockwise direction about the axis A1. However, the rotation of the plate 22 is blocked through the locking disk 720 cooperating with the periphery 220 of the plate. The support 2 is thus held in initial angular position thereby. The spring is thus tightened until the pin 84 of the spring 81 comes to be housed in the second notch 221*b* of the plate 22, as represented in FIG. 10. In this figure, the plate 22 remains blocked in angular position as explained previously. The indication member 1 has then traveled almost all the extent of the limb.

Then, in a fourth step represented in FIG. 10, the display system unlocks the position of the support 2. In effect, when the indication member 1 arrives at the end of the limb, the third mobile 71 arrives in a configuration in which the locking disk unlocks and therefore authorizes the rotation of the plate 22. It then follows that the pin 84 is thus free to drive the plate 22 through its notch 221*b* under the effect of the return from the spring 81. Thus, the support 2 is displaced thanks to a mechanical energy released by the energy accumulator. In effect, the plate 22 is driven in rotation by a quarter revolution in the anticlockwise direction until it arrives in the configuration of FIG. 11, i.e. in a configuration similar to that represented in FIG. 7. The rotation of the plate is instantaneous.

"Instantaneous rotation" is understood to mean a rotation of the order of a fraction of a second. This rotation is generated by the return of energy from the spring. Between the configurations of FIGS. 10 and 11, the plate has revolved by 90°. For this, the four notches 221*a*, 221*b*, 221*c*, 221*d* are evenly distributed about the axis of rotation A1 of the second mobile 21.

FIG. 1 illustrates the display system 100 just after the return of energy from the spring 81. The pin 84 is once again pressed against the abutment 83*a*, and holds the plate 22 in position through the notch 221*b*. In this configuration, the support 2 is advantageously arranged so that the graphic element "30" appears in the aperture 10*a*. Through this, the support 2 is thus capable of performing instantaneous jumps of 90°. Such jumps therefore allow the display system 100 to switch from the first configuration C1 illustrated in FIG. 1 to the second configuration C2 illustrated in FIG. 2 or vice versa.

In a fifth step, the operation of the chronograph system is stopped. The display system then indicates the time measured and recorded. This stop can be ordered by an action of the wearer of the timepiece on a control member.

In a sixth step, the display system is reinitialized or reset to zero.

This sixth step comprises, for example, a first phase in which the wearer of the timepiece exerts an action on the display system, in particular an elementary action of the user on the display system, in particular on the control member, for example a press by the user on the push-piece OC of the display system. The action can be elementary inasmuch as only one elementary movement is necessary to trigger the reinitialization or the resetting to zero. For example, only the press movement on the push-piece is necessary, the return movement not being necessary to the ordering of the reinitialization or of the reset to zero.

Then, as a consequence of the action, the time or time derivative information displayed by cooperation of the indication member and of the limb is reset to a predetermined configuration, in particular is reset to zero. In particular, the indication member 1 is arranged in the first predetermined configuration and/or the graphic element is reset to the second predetermined configuration.

In a first sub-phase of actuation of the hammer under the action of the wearer of the timepiece, the first peen 31 comes into contact with the cam 3 so that the indication member revolves about the axis A1 until it reaches the first predetermined configuration P1. It then follows that all of the first mobile revolves and that the third mobile consequently also revolves to reach a configuration in which the plate can revolve and be brought into a configuration represented by FIG. 7 or FIG. 11 if it was not already there. The plate is then in a stable position, the second end of the spring being in contact with the abutment 83*a*.

Once the indication member 1 is arranged in the first predetermined configuration P1, and the peen 31 is in contact with the flat of the heart 3, the hammer 34 can continue its travel so as to allow, in a second sub-phase of actuation of the hammer, the actuation of the cam 4 through the second peen 41 under the effect of the elastic deformation of the arm 31*a*. The hammer 34 is thus conformed so that it can act on the cam 3 in a first sub-phase of actuation, and that it can act on the cam 4 in a second sub-phase of actuation. The action of the peen 41 on the cam 4 provokes the rotation of the cam 4 about the axis A1 and therefore the rotation of the support about the axis A1. Because of the friction that exists between the support and the plate, the support can, in this operation, revolve without the plate revolving. It is thus possible to reset the graphic element, in particular the support to the second predetermined configuration P2.

FIG. 12 represents the system before the resetting to predetermined configurations P1, P2. In this figure, the first and second peens 31, 41 are respectively out of reach of the cams 3 and 4. FIG. 13 represents the device once the indication member 1 and the support 2 have been reset to predetermined configurations P1 and P2 under the effect of the hammer 34 which is actuated by the control member OC. In this figure, the first and second peens 31, 41 are respectively in contact with the cams 3 and 4 under the effect of the control member OC.

According to a second aspect, an embodiment of a timepiece 300 is described hereinbelow with reference to FIGS. 1 to 14. The timepiece is preferably a watch, in particular a wristwatch.

The timepiece comprises a horological movement. The horological movement can be of electronic or mechanical type, in particular automatic.

The horological movement advantageously comprises a chronograph system, for example a chronograph module.

The horological movement, in particular the chronograph system, comprises an embodiment of a system 150 for actuating the second mobile 21, in particular for actuating a disk displaying time or time derivative information.

The system 150 for actuating the second mobile 21 comprises:

- the frame 9 on which the second mobile 21 is pivoted about the axis A1,
- the energy accumulator 8,
- the mechanism 71 for transmitting energy to the accumulator, and
- a mechanism 720 for authorizing the movement of the second mobile 21 under the effect of an energy supplied by the accumulator.

The energy accumulator 8 can comprise the spring 81, in particular the hairspring, fixed at its first end 81*b* to the frame 9 and bearing at its second end 81*a* against the second mobile 21, the second mobile comprising several notches 221*a-d* intended to successively receive the second end of the spring.

The transmission mechanism can comprise the third mobile 71 driven in movement, in particular driven in rotational movement, about the axis A2 parallel or substantially parallel to the first axis A1, the third mobile comprising the finger 72 arranged so as to act on the energy accumulator to tighten it, in particular to act on the second end of the spring to displace it from one notch to another.

The authorization mechanism can comprise a fourth mobile provided with a locking disk 720 provided with the first cutout 721, driven in movement, in particular driven in rotational movement, about an axis parallel or substantially parallel to the first axis A1 and cooperating with several second notches 223*a-d* produced on the first mobile to lock or authorize the rotation of the second mobile, the locking disk having a first configuration in which the rotation of the first mobile is authorized and a second configuration in which the rotation of the first mobile is prohibited by obstruction with the locking disk.

The axes of rotation of the locking disk and of the third mobile can coincide or be distinct.

Preferably, the third and fourth mobiles are one and the same mobile.

Preferably, the notches are formed at the vertices of a regular polygon centered on the first axis A1.

Preferably, each notch is linked by guiding surfaces or flanks 222*a-d* to the adjacent notches.

Preferably, each notch is arranged so as to cooperate with the energy accumulator to define a stable position of the second mobile, the energy accumulator producing an effort causing to return the second mobile to the stable position defined by the cooperation of the accumulator, of the notch and of the abutment 83*a*.

The second mobile can comprise a body 22 or plate provided with the notches and a member 2 of the second mobile 21, in particular a support or disk 2, mounted to be mobile with friction, in particular mobile by indenting, on the body about the axis A1.

The actuation system can comprise a device 4, 34 for resetting the first mobile to a predetermined configuration comprising an element 4 for resetting the member 2 of the second mobile 21 to a predetermined configuration, in particular a cam 4.

According to the second aspect, an embodiment of a method for operating an actuation system as described previously or a horological movement as described previously or a timepiece as described previously comprises the following steps:

- setting of the second mobile to a first configuration, then
- action of a user on the actuation system, in particular an elementary action of the user on the actuation system, for example a press by the user on a push-piece OC of the actuation system, then
- as a consequence of the action step, resetting of the second mobile to a predetermined configuration.

The action of setting to a first configuration can comprise the following steps:

- tightening of the energy accumulator by action of the finger 72, in particular tightening of the spring by action of the finger 72 displacing an end of the spring, then
- unlocking of the position of the second mobile 21, then displacement of the second mobile 21 thanks to a mechanical energy released by the energy accumulator.

According to another aspect, an embodiment of a method for operating an actuation system as described previously or a horological movement as described previously or a timepiece as described previously comprises the following steps:

tightening of the energy accumulator by action of the finger 72, in particular tightening of the spring by action of the finger 72 displacing an end of the spring, then unlocking of the position of the second mobile 21, then displacement of the second mobile 21 thanks to a mechanical energy released by the energy accumulator.

As seen previously, as a consequence of the action step, the second mobile is reset to a predetermined configuration, in particular the body 22 can be brought into the first predetermined configuration P1 and/or the member 2 can be brought into the second predetermined configuration P2. This is performed for example by the action of the hammer.

In a first sub-phase of actuation of the hammer, under the action of the wearer of the timepiece, the first peen 31 comes into contact with the cam 3 so that the third mobile revolves accordingly to reach a configuration in which the body 22 can revolve and be brought into a configuration represented by FIG. 7 or FIG. 11 if it was not already there. The body 22 is then in a stable position, the second end of the spring being in contact with the abutment 83*a*.

Once the body is arranged in the first predetermined configuration P1 and the peen 31 is in contact with the flat of the heart 3, the hammer 34 can continue its travel so as to allow, in a second sub-phase of actuation of the hammer, the actuation of the cam 4 through the second peen 41 under the effect of the elastic deformation of the arm 31*a*. The hammer 34 is thus conformed so that it can act on the cam 3 in a first sub-phase of actuation, and that it can act on the cam 4 in a second sub-phase of actuation. The action of the peen 41 on the cam 4 provokes the rotation of the cam 4 about the axis A1 and therefore the rotation of the member 2 about the axis A1. Because of the friction that exists between the member 2 and the body 22, the member 2 can, in this operation, revolve without the body 22 revolving. It is thus possible to reset the member 2 to the second predetermined configuration P2.

In the different aspects and/or embodiments described previously, the systems, devices and methods have been used to implement a chronograph function. However, according to the different aspects and/or embodiments, the systems, devices and methods can be used for any other horological function, in particular a flyback function.

In the different aspects and/or embodiments described previously, the systems, devices and methods have been used to implement a counter. However, according to the different aspects and/or embodiments, the systems, devices and methods can be used to implement several counters of one and the same timepiece. Thus, several actuation systems and/or several display systems can be provided on one and the same timepiece or on one and the same movement or on one and the same chronograph system. For example:

an actuation system and/or a display system can be provided to indicate the fractions of seconds; and/or an actuation system and/or a display system can be provided to indicate the seconds; and/or an actuation system and/or a display system can be provided to indicate the minutes; and/or an actuation system and/or a display system can be provided to indicate the hours.

In the different aspects and/or embodiments described previously, the systems, devices and methods have been used to implement a chronograph function. The chronograph can be started and stopped on demand through a conventional chronograph mechanism.

In the different aspects and/or embodiments described previously, the systems, devices and methods have been described with circular limbs and indicator members performing a complete limb revolution. However, according to the different aspects and/or embodiments, the systems, devices and methods can involve non-circular limbs cooperating with indication members of retrograde type.

In the different aspects and/or embodiments described previously, the systems, devices and methods have been described with a plate or second mobile performing instantaneous 90° jumps. However, according to the different aspects and/or embodiments, the systems, devices and methods can relate to embodiments in which a plate or second mobile performs instantaneous jumps of any other angular value.

In the different aspects and/or embodiments described previously, the systems, devices and methods have been described with three apertures associated with a limb. However, according to the different aspects and/or embodiments, the systems, devices and methods can relate to embodiments in which another number of apertures, in particular 1 or 2 or 4 or 5 or 6 or 10 or 12 apertures, are associated with a limb.

In the different aspects and/or embodiments described previously, the systems, devices and methods have been described with three apertures associated with a limb and arranged at 120° relative to the axis A1 and a support 2 performing 90° jumps relative to the axis A1 and graphic elements arranged every 30° relative to the axis A1 on the support. This configuration is advantageous, because it makes it possible to arrange two sets of graphic elements on the support 2.

Thanks to the solutions described previously, it is possible to modify the interpretation of a position of an indication member relative to a limb by providing a display of the type jumping by at least one limb reference.

Preferably, in the above disclosed embodiments, the at least one modifiable graphic element is arranged such that, in the several configurations of the at least one modifiable graphic element, the at least one modifiable graphic element defines or helps to define several complementary ranges of a value scale of time or time derivative information, notably of a measured time.

For instance, in a first configuration of the at least one modifiable graphic element, the at least one modifiable graphic element defines or helps to define a first range of values displayable on the scale and in a second configuration of the at least one modifiable graphic element, the at least one modifiable graphic element defines or helps to define a second range of values displayable on the scale. Preferably, the first and second ranges are complementary and their union defines a whole scale of values. For instance, the first range of values is [0;30], the second range of values is [30;60] and the whole scale of values is [0;60]. In the embodiment shown on the figures, three modifiable graphic elements are used. In the embodiment shown on the figures:

a first graphic element 20*a* gives the value "0" at a first place, notably in a first aperture 10*a*, in a first configuration and a fourth graphic element 20*d* gives the value "30" at the first place in a second configuration, a second graphic element 20*b* gives the value "10" at a second place, notably in a second aperture 10*b*, in the first configuration and a fifth graphic element 20*e* gives the value "40" at the second place in the second configuration, a third graphic element 20*c* gives the value "20" at a third place, notably in a third aperture 10*c*, in the first configuration and a sixth graphic element 20*f* gives the value "50" at the third place in the second configuration.

The first graphic element and the fourth graphic element may be considered as a single first modifiable graphic element.

The second graphic element and the fifth graphic element may be considered as a single second modifiable graphic element.

The third graphic element and the sixth graphic element may be considered as a single third modifiable graphic element.

More generally, the several configurations of the at least one modifiable graphic element may define or may help to define more than two complementary ranges, notably three, four, five or six complementary ranges. The number of complementary ranges is defined by the number of the configurations. Preferably, there are as much distinct or different configurations as complementary ranges. Preferably, the amplitudes of the various complementary ranges are equal.

The invention claimed is:

1. A system for displaying time or time derivative information, the system comprising:

a limb comprising at least one modifiable graphic element forming time or time derivative reference information, a time or time derivative information indication member in cooperation with the limb, a device for modifying the at least one modifiable graphic element, and a device for resetting, by action of a user, to a predetermined configuration, the time or time derivative information displayed by cooperation of the indication member and of the limb, wherein the device for modifying the at least one modifiable graphic element comprises:

a support having the at least one modifiable graphic element, an energy accumulator, a mechanism for transmitting energy to the accumulator in at least one selected from the group consisting of (i) as and when display of the time or time derivative information is incremented and (ii) upon the displacement of the indication member, and a mechanism for authorizing the movement of the support under the effect of energy supplied by the accumulator, when at least one selected from the group consisting of (i) the display of the time or time derivative information reaches a predetermined value and (ii) the indication member reaches a predetermined position, wherein the device for resetting to a predetermined configuration comprises a first element for resetting the indication member to a predetermined configuration and a second element for resetting the at least one modifiable graphic element to a predetermined configuration.

2. The display system as claimed in claim 1, wherein the device for modifying the at least one modifiable graphic element is a device for driving the at least one modifiable graphic element and wherein the at least one modifiable graphic element is arranged so as to be displaced under the effect of the device for modifying the at least one modifiable graphic element and arranged so as to be reset to a determined position by the resetting device.

3. The display system as claimed in claim 1, wherein the at least one modifiable graphic element is arranged so that, in several configurations of the at least one modifiable graphic element, the at least one modifiable graphic element defines or helps to define several complementary ranges of a value scale of time or time derivative information.

4. The display system as claimed in claim 3, wherein the device for resetting to a predetermined configuration is arranged so as to position the indication member in the predetermined configuration and the at least one modifiable graphic element in the predetermined configuration by the action of one and the same control member.

5. The display system as claimed in claim 4, wherein the device for resetting to a predetermined configuration is arranged so as to position the indication member in a first predetermined configuration and the at least one modifiable graphic element in the second predetermined configuration by the action of one and the same control member via a single action on the control member.

6. The display system as claimed in claim 1, wherein the energy accumulator comprises a spring fixed at a first of its ends to a frame and bearing at a second of its ends against a plate that is mobile relative to the frame, the plate being secured to the support, the plate comprising several notches intended to successively receive the second end of the spring.

7. The display system as claimed in claim 6, wherein the spring is a hairspring, the plate is mobile in rotation relative to the frame, and the plate is secured to the support by friction or by indenting.

8. The display system as claimed in claim 1, wherein the transmission mechanism comprises a mobile kinematically linked with the indication member, the mobile comprising a finger arranged so as to act on the energy accumulator to displace energy accumulator from one notch to another.

9. The display system as claimed in claim 1, wherein the authorizing mechanism comprises a locking disk provided with a first cutout, kinematically linked with the indication member and cooperating with a plate provided with several second cutouts and secured to the support, to lock or authorize the rotation of the plate, the locking disk having a first configuration in which the rotation of the plate is authorized and a second configuration in which the rotation of the plate is prevented by obstruction with the disk.

10. The display system as claimed in claim 1, wherein at least one selected from the group consisting of:

(i) the device for resetting to a predetermined configuration comprises a hammer and a first cam secured to the indication member and intended to receive an action of a first peen of the hammer, and (ii) the device for resetting to a predetermined configuration comprises a hammer and a second cam secured to the support and intended to receive an action of a second peen of the hammer.

11. The display system as claimed claim 10, wherein the device for resetting to a predetermined configuration comprises a hammer and a first cam secured to the indication member and intended to receive an action of a first peen of the hammer, wherein the first cam is a heart cam.

12. The display system as claimed in claim 10, wherein the first peen is mounted to be mobile relative to a body of the hammer, and wherein the hammer comprises an element for returning the first peen to a position of rest relative to the body of the hammer.

13. The display system as claimed in claim 12, wherein the first peen is mounted to be mobile in translation along a first axis relative to a body of the hammer, and wherein the element for returning the first peen to a position of rest relative to the body of the hammer is for returning the first peen to a position of rest relative to the second peen.

14. A horological movement comprising a system as claimed in claim 1.

15. A timepiece comprising a system as claimed in claim 1.

16. A method for operating a display system as claimed in claim 1, the method comprising the following steps:

displaying time or time derivative information by cooperating of the indication member and of the limb, then performing an action by a user on the display system, then as a consequence of the action, resetting to the predetermined configuration the time or time derivative information displayed by cooperation of the indication member and of the limb.

17. The operating method as claimed in claim 16, wherein the displaying comprises:

tightening an energy accumulator by action of a finger, then unlocking the position of a support, then displacing the support using a mechanical energy released by the energy accumulator.

18. A method for operating a display system as claimed in claim 1, the method comprising:

tightening the energy accumulator by action of a finger, then unlocking the position of the support, then displacing the support using a mechanical energy released by the energy accumulator.

19. The display system as claimed in claim 1, wherein the resetting device is adapted for resetting to zero.

* * * * *